United States Patent [19]

Wojcicki

[11] 4,301,554

[45] Nov. 24, 1981

[54] DRAIN TRAP

[76] Inventor: Mario J. Wojcicki, 9 Lyncourt, St. Thomas, Ontario, Canada

[21] Appl. No.: 86,500

[22] Filed: Oct. 19, 1979

[30] Foreign Application Priority Data

Oct. 30, 1978 [CA] Canada ..... 314884

[51] Int. Cl.[3] ..... E03C 1/26; E03C 1/282; E03C 1/284

[52] U.S. Cl. ..... 4/206; 4/255; 4/292; 4/DIG. 14; 137/247.51; 210/312; 210/447

[58] Field of Search ..... 4/191, 197, 206, 207, 4/286, 292, DIG. 14, 255; 137/247.41, 247.51, 358; 210/447, 435, 410–313

[56] References Cited

U.S. PATENT DOCUMENTS

| | | | |
|---|---|---|---|
| 861,493 | 7/1907 | Bell | 210/447 |
| 976,593 | 11/1910 | Newsome | 4/255 |
| 1,217,763 | 2/1917 | Hirrich | 4/DIG. 14 |
| 1,817,376 | 8/1931 | Izquierdo | 4/DIG. 14 |
| 1,884,855 | 10/1932 | Pryce | 137/247.51 |
| 2,690,232 | 9/1954 | Brem | 4/DIG. 14 |
| 3,488,901 | 9/1969 | Reid | 4/DIG. 14 |
| 3,935,602 | 2/1976 | Kale | 137/247.41 X |
| 4,032,455 | 6/1977 | Kale | 210/447 |
| 4,164,048 | 8/1979 | Kampfer et al. | 4/DIG. 14 |
| 4,179,762 | 12/1979 | Barnhardt et al. | 4/DIG. 14 |

FOREIGN PATENT DOCUMENTS

| | | | |
|---|---|---|---|
| 2756243 | 7/1979 | Fed. Rep. of Germany | 137/247.51 |

*Primary Examiner*—Stuart S. Levy
*Attorney, Agent, or Firm*—John J. Byrne

[57] ABSTRACT

A drain trap includes a J-shaped pipe section having an opening at one end of the horizontal portion. A removable tray is inserted through the opening and covers the bottom of the horizontal portion on the inside thereof. The tray has sides extending part way up the sides of the horizontal portion. An end cover on the tray is adapted to cover and seal the opening. A U-shaped spring clamp extending across the back of the end cover holds the cover against the pipe section. The tray is provided with three groups of vertically extending fingers which strain material such as food and hair from water flowing through the pipe section. This material can then be disposed of by removal of the tray from the pipe section.

9 Claims, 10 Drawing Figures

DRAIN TRAP

FIELD OF THE INVENTION

This application relates to drain traps suitable for use in connection with sinks, laundry tubs and the like.

DESCRIPTION OF THE PRIOR ART

Plugging is a common problem with presently used drain traps as undesirable material such as hair, rags and other debris is often pulled into the trap by the downward flowing water. The commonly used drain traps are hard to clean and cleaning may require the service of a plumber. If chemicals are used to unclog the plug drain, the chemical may present a hazard to the user if not treated with proper care. In addition the strong chemical enters the water system and adds to water pollution problems. Moreover, depending upon the nature of the material plugging the drain, the chemical drain cleaner may not be effective.

SUMMARY OF THE INVENTION

The present invention provides a drain trap which can be readily cleaned by most householders without the use of any expensive tools. Moreover the drain trap described herein provides means for easily removing the dirt or foreign matter from the bottom of the trap and placing the unwanted material in a garbage retainer without any need for reaching in to the drain trap with one's hand.

The present invention provides a drain trap comprising a pipe section having two upwardly facing openings and a third opening at one side of the section, a removable tray adapted for insertion through the third opening and adapted to cover a bottom portion of the interior of said section, said tray having sides extending part way up the sides of said section, and an end cover adapted to cover and seal said third opening. Means are also provided for holding the end cover against the pipe section so that the end cover sealingly closes the opening.

In the preferred embodiments disclosed herein, straining means in the form of vertically extending fingers are provided in the tray to capture any undesirable material in the flow of water which should not be allowed to pass beyond the drain trap. The end cover is preferably held tightly against the pipe section by means of a threaded cap. Alternatively, the end cover may be retained by a U-shaped wire spring which extends across the back of the end cover and horizontally along opposite sides of the pipe section.

BRIEF DESCRIPTION OF THE DRAWINGS

Further features and advantages will become apparent from a following detailed description of a preferred embodiment taken in conjunction with the accompanying drawings wherein.

DESCRIPTION OF THE PREFERRED EMBODIMENTS

Figure 1:
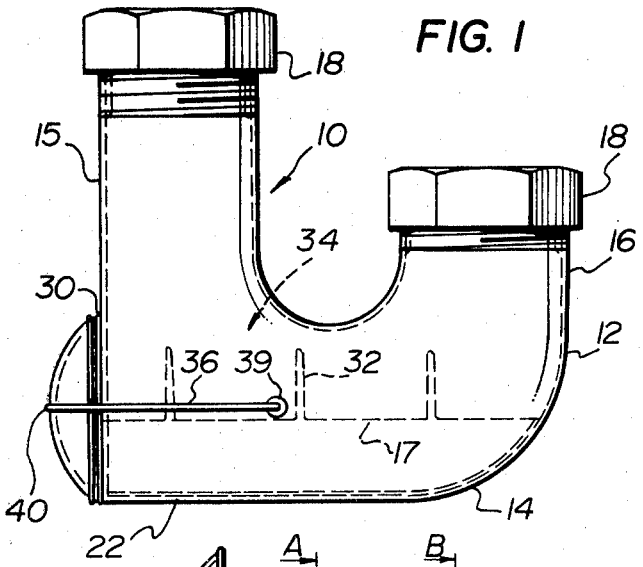
FIG. 1 is a side elevation of the pipe section of the present invention with the removable tray inserted therein.
Figure 5:
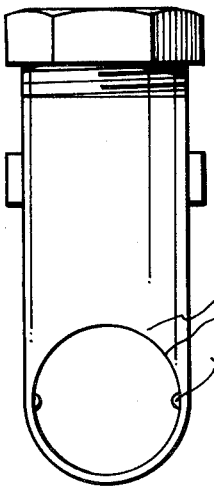
FIG. 5 is an end view of the pipe section shown in FIG. 1 with the tray removed.

As shown in FIG. 1, the drain trap 10 comprises a pipe section 12 having a horizontal portion 14 and two upwardly extending legs 15 and 16 at opposite ends of the horizontal portion and a removable tray 17. In the embodiment shown, the horizontal portion 14 and the legs 15 and 16 form a J-configuration, a common configuration for drain traps. The upper end of each leg can be threaded and provided with a nut 18 for connecting the pipe section to an adjoining drain pipe. As can be seen clearly from FIG. 5 an opening 19 is formed at one end of the horizontal portion 14. In the embodiment shown, this opening is circular and it should be appreciated that the pipe section is shaped so that the outside surface 20 about the perimeter of the opening 19 lies in a vertical plane. Unlike the pipe sections for most drain traps, the horizontal portion of the pipe section has a straight portion 22 extending for approximately two-thirds of the length of the horizontal portion.

Figure 2:
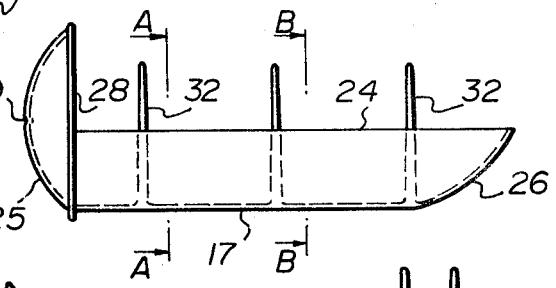
FIG. 2 is a side elevation of the removable tray removed from the pipe section.
Figure 3:
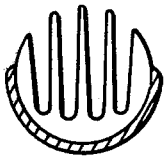
FIG. 3 is a sectional view taken along line A—A in FIG. 2 and showing the straining fingers in the middle of the tray.
Figure 4:
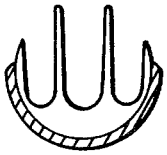
FIG. 4 is a sectional view taken along line B—B in FIG. 2.

Returning now to the construction of the tray 17 shown clearly in FIG. 2, this tray consists of an elongated body portion 24 and an end cover 25. As can be seen from FIGS. 3 and 4, the body portion 24 has a semi-circular shape in cross-section for most of its length and the exterior diameter of this portion is just slightly smaller than the interior diameter of a bottom half of the horizontal portion 14. Thus the tray 17 is adapted for insertion through the opening 19 and the body portion 24 is accommodated in the bottom of the horizontal portion 14. As can be seen from FIG. 1, the body portion 24 covers the entire bottom of the horizontal portion 14. The end of the body portion 24 opposite the cover 25 curves upwardly at 26 so as to follow the bend in the pipe section. The end cover 25 is a partial sphere bounded by a circular rim or flange 28. A suitable indentation 29 can be formed about the vertical centre of the end cover to accommodate a spring clamp described hereinafter.

Prior to insertion of the tray through the opening 19, a gasket seal is preferably arranged about the curvature of the opening. This circular seal 30 shown in FIG. 1 can be made of neoprene and is approximately one-sixteenth of an inch thick. This gasket seal is clamped between the flange 28 and the pipe section when the tray is completely inserted. The seal ensures that the opening 19 is tightly sealed when the end cover is in place over the opening.

Means are provided in the tray 17 for straining undesirable material from water flowing through the drain trap. It is desirable to catch some foreign substances and objects before they pass through the trap as they may plug the drain pipe downstream of the trap and it is a time consuming and difficult job to clean out the line below the trap. To catch this material three groups of upwardly extending fingers 32 can be provided. The three groups are evenly distributed along the length of the body portion 24 of the tray. The fingers in the centre group can be seen in FIG. 3 while the fingers in the group on the right side can be seen in FIG. 4. The arrangement of the fingers on the left side of the tray, as seen in FIG. 2, can be the same as the arrangement shown in FIG. 3 or FIG. 4. It will be appreciated that the number of groups of fingers in the tray can vary anywhere from one to more than three. If there is only one group of fingers, it is preferred that this group be arranged in approximately the centre of the tray. In the embodiment shown, the central group of fingers 32 is disposed approximately at the longitudinal centre of the horizontal portion 14 and the fingers of this group extend for at least most of the distance across the internal passageway 34 of the pipe section.

Figure 6:
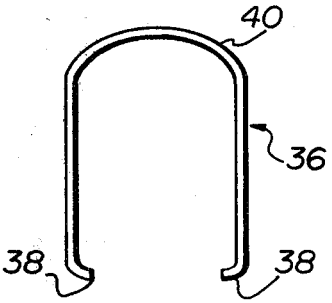
FIG. 6 is a top view of the spring clamp used to hold the tray in place.

Means are provided for holding the end cover 25 against the pipe section for otherwise the water running into the drain trap will simply push the end cover outwardly. A simple inexpensive means for holding the end cover in place consists of a spring clamp 36 which extends across the back of the end cover and along opposite sides of the horizontal portion 14. The shape of the clamp can be seen clearly from FIG. 6. The clamp is generally U-shaped and consists of a wire spring having two ends 38 which are bent inwardly towards each other. These bent ends which are quite short are received in two cavities 39 formed on the sides of the pipe section 12. The base portion 40 of the clamp is held in position over the back of the end cover by the aforementioned indentation 29. The spring clamp can be made from galvanized steel, chrome-plated steel or stainless steel. The indentations 39 in the pipe section can be molded, stamped or formed by other known means.

The pipe section 12 and the tray 17 can be formed from wellknown pipe materials such as galvanized steel, chrome-plated steel, or stainless steel or a plastics material such as A B S (acrylonitrile-butadiene-styrene). It is also possible to make these portions of the drain trap from transparent material such as acrylic plastics. Transparent material has the advantage of making it easy to determine whether or not the drain trap should be cleaned out and whether or not any drainage problem is located in the drain trap.

In order to clean the drain trap of the invention, the base portion 40 of the spring clamp is simply pulled downwardly either by hand or with the use of a simple tool such as a screw driver. As the clamp is pulled, it pivots about the cavities or pivot points 39. Once the base portion 40 of a clamp is clear of the end cover 25, the tray 17 can simply be pulled out of the pipe section. Any unwanted matter caught in the fingers 32 can then be readily removed and disposed of. The trap can then be cleaned. The procedure is simply reversed for replacing the tray back into the pipe section.

If desired, the tray 17 can be made from a single piece of material either by pressing or molding.

Another form of drain trap for use in connection with sinks and laundry tubs is shown in FIGS. 7 to 10. This drain trap is also provided with two upwardly facing openings and a third opening at one end of the pipe section. A removable tray is adapted for insertion through the side opening and, when in place, it covers a bottom portion of the interior of the pipe section. The end cover can be a separate internally threaded cap, with the pipe section having mating threads for the cap around the third opening. The pipe section has a main portion of substantially semitoroidal configuration with one of the upwardly facing openings formed at each end of the main portion. This form of drain trap includes a horizontal extension with the third opening being located at the outer end of the horizontal extension.

Figure 7:
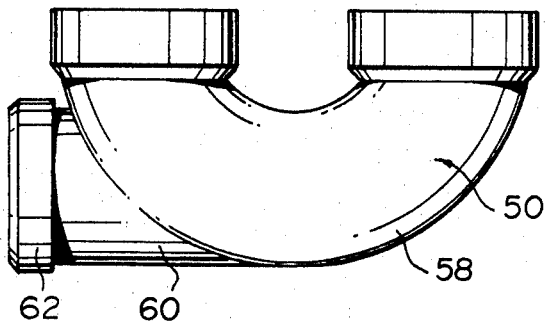
FIG. 7 is a side elevation of a pipe section of the present invention with the cover cap in place.
Figure 8:
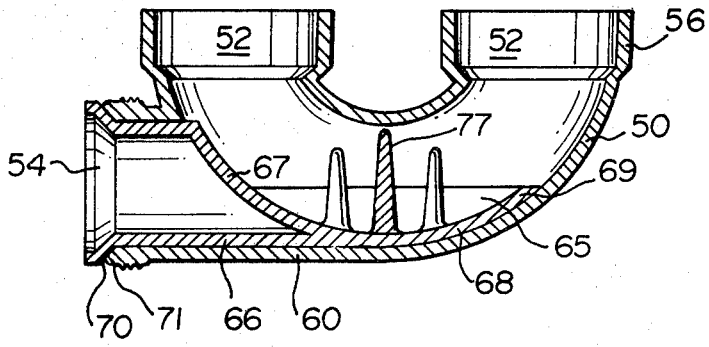
FIG. 8 is a sectional elevation taken along the plane of the center line of the pipe section shown in FIG. 7, this figure also illustrating the placement of the removable tray.

As shown in FIGS. 7 and 8, the modified drain trap 50 comprises a pipe section having two upwardly facing openings 52 and a third opening 54 at one side of the pipe section. Unlike the first embodiment of the drain trap shown in FIG. 1, this embodiment has no upwardly extending legs except for two short pipe connecting sections 56, each of which surround one of the openings 52. The length of these sections in one preferred embodiment is only 0.70".

The pipe section of the drain pipe has a main portion 58 of substantially semi-toroidal configuration and a horizontal extension 60. On the exterior of the extension 60 are threads for connecting an end cover in the form of a separate internally threaded cap 62. The cap if desired can be formed with lugs or can have a non-circular outer configuration to permit easy removal.

The drain trap includes a removable tray 64 having sides 65 which extend part way up the sides of the main portion 58 on the inside thereof as can be seen from FIG. 8. The tray includes a hollow cylindrical end section 66 which is open at the outer end and closed by a wall 67 located in use in the main portion 58. The wall 67 is in effect an extension of the curved bottom 68 of the tray and end wall 69. The wall 67, bottom 68, and end wall 69 have substantially the same curvature as the main portion 58 of the pipe section. This permits a smooth, quiet flow of water through the drain trap. The side 65, bottom 68 and walls 67 and 69 form a collecting portion which is open in the upwards direction.

The outer end of the tray is preferably formed with a sloping shoulder 70 which permits easy removal of the tray from the pipe section and provides for a better seal. The outer end of the horizontal extension 60 is bevelled on the inside surface at 71 and the angle of this bevel corresponds to the slope of the shoulder 70. The shoulder 70 also permits accurate placement of the tray in the pipe section.

Figure 9:
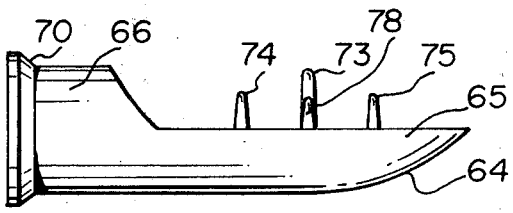
FIG. 9 is a side view of the removable tray shown in FIG. 8.

As with the tray of the first embodiment, the tray 64 is provided with three groups of upwardly extending fingers, the groups being spaced apart in the lengthwise direction of the tray. These fingers also act to strain material from water flowing through the pipe section, which material can be disposed of by removal of the tray from the pipe section. In the preferred arrangement shown, the center group of fingers 73 has three fingers while the two outer groups 74 and 75 have two fingers in each group. The center group 73 has one long finger 77 located in the transverse center of the tray, which finger extends almost entirely across the passageway in the pipe section. The two remaining fingers 78, only one of which is shown in FIG. 9 are located on opposite sides of the center finger and are evenly spaced therefrom. These two fingers 78 are slightly shorter in length. Each of the fingers in the outer groups 74 and 75 is shorter than the center finger 77 but slightly longer than the finger 78.

Figure 10:
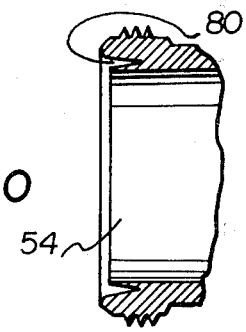
FIG. 10 is a sectional detail of an alternate construction of the pipe section.

If desired, the pipe section at the opening 54 can be formed in the manner shown in FIG. 10. In this embodiment the pipe end around the opening is undercut to form a V-shaped recess 80. A suitable flexible seal is fitted into this recess to be engaged by the cap 62. The use of such a seal or gasket is not essential but might be desired by some drain trap installers.

I claim:

1. A drain trap comprising:

a tubular-wall pipe section having a portion of semi-toroidal configuration and a lateral drain trap opening defined in the wall of said semi-toroidal portion communicating with an inlet extension oriented generally tangentially with respect to said semi-toroidal portion;

a removable trap adapted for insertion through said drain trap opening and comprising a collecting tray and an integral mounting section, said trap being adapted for location in an operative position wherein the tray lies against and covers the bottom part of the internal wall surface of said toroidal portion;

said tray having a curvature which matches that of said bottom part and having walls which extend transversely part way up the sides of the internal wall of the bottom part, and extend longitudinally along a substantial portion of the length of said semi-toroidal portion, said tray including one wall portion which in the operative position completely covers said lateral opening;

retaining means engageable with said inlet extension to retain said trap in the operative position; and sealing means for forming a fluid seal in said inlet extension.

2. A drain trap according to claim 1 wherein said retaining means comprises an end cover in the form of a separate internally threaded cap and said inlet extension has mating threads for said cap.

3. A drain trap according to claim 2 wherein said sealing means is a gasket seal arranged between the end cover and the inlet extension.

4. A drain trap according to claim 2 wherein said mounting section is of tubular form and fills said inlet extension.

5. A drain trap according to claim 1 wherein the pipe section is made of a transparent material.

6. A drain trap according to claim 1 wherein the pipe section is made of a transparent acrylic plastics material.

7. A drain trap according to any one of claims 1, 3, 5, 6, 2 or 4 wherein said tray includes means for straining material from water flowing through the pipe section, which material can be disposed of by removal of said tray from said pipe section.

8. A drain trap according to claim 1 including means for straining material from water flowing through said pipe section, which material can be disposed of by removal of said tray from said pipe section, said straining means consisting of at least one group of upwardly extending fingers disposed in spaced apart fashion across the width of said tray.

9. A drain trap according to claim 8 including three groups of upwardly extending fingers, the groups being spaced apart in the longitudinal direction of the tray.

* * * * *